US006378574B2

(12) United States Patent
Tsutsui

(10) Patent No.: US 6,378,574 B2
(45) Date of Patent: Apr. 30, 2002

(54) ROTARY TYPE CONTINUOUS FILLING APPARATUS

(75) Inventor: Shoji Tsutsui, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 09/819,926

(22) Filed: Mar. 28, 2001

(30) Foreign Application Priority Data

Mar. 31, 2000 (JP) ..... 2000-096164

(51) Int. Cl.[7] ..... B65B 43/42; B67C 3/00

(52) U.S. Cl. ..... 141/146; 141/148; 141/258; 137/146; 222/380

(58) Field of Search ..... 141/129, 146, 141/148, 249, 250, 258, 234, 242; 222/302, 372, 380; 137/246, 246.11, 237, 625.21, 625.23, 625.46; 251/208

(56) References Cited

U.S. PATENT DOCUMENTS

| | | | | |
|---|---|---|---|---|
| 2,185,201 | A | * | 1/1940 | Kraus |
| 3,195,781 | A | * | 7/1965 | Egleston |
| 3,841,363 | A | * | 10/1974 | Stigler ..... 141/142 |
| 4,842,026 | A | * | 6/1989 | Nordmeyer et al. ..... 141/1 |
| 5,230,373 | A | * | 7/1993 | Engler ..... 141/147 |

FOREIGN PATENT DOCUMENTS

| | | | |
|---|---|---|---|
| DE | 1 532 538 | * | 3/1970 |
| JP | S59-42399 | * | 12/1984 |
| JP | S63-637 | * | 1/1988 |
| JP | H03-38552 | * | 8/1991 |
| JP | H06-18881 | * | 5/1994 |
| JP | H08-295397 | * | 11/1996 |
| JP | 2839828 | * | 10/1998 |

* cited by examiner

*Primary Examiner*—Timothy L. Maust
(74) *Attorney, Agent, or Firm*—Koda & Androlia

(57) ABSTRACT

A rotary type continuous filling apparatus that continuously fills bags accommodated in retainers with a filling liquid via filing nozzles. A cylinder of each of the pump devices that correspond to the respective filling nozzles is installed horizontally with the discharge opening facing outward. The discharge opening communicates with a feed-out opening of a nozzle main body, and a tank containing the filling liquid communicates with a supply opening of the nozzle main body via a flow passage. A cam roller is connected to the piston via swing levers, vertical supporting shafts and cam levers, and these cam rollers move along an annular cam groove of a piston operating cam. Furthermore, each filling nozzle has a flow passage switching valve that switches between a communication and non-communication of the supply opening and the feed-out opening, and it also has an opening-and-closing valve that opens and closes the discharge port.

6 Claims, 6 Drawing Sheets

ROTARY TYPE CONTINUOUS FILLING APPARATUS

BACKGROUND OF THE INVENTION

1. Field of the Invention

The present invention relates to a rotary type continuous filling apparatus which continuously fills containers with a filling liquid.

2. Prior Art

Japanese Utility Model Application Publication (Kokoku) Nos. S59-42399 and S63-637, for instance, disclose a typical rotary type continuous filling apparatus. This rotary type continuous filling apparatus is equipped with: a tank installed on a continuously rotating filling rotor; a plurality of filling nozzles which are disposed in vertical positions at equal intervals around the periphery of the filling rotor; pump devices which are disposed in positions that correspond to the respective filling nozzles and in each of which a piston reciprocates upon the rotation of the filling rotor, so that a filling liquid is sucked into a cylinder from the tank and discharged toward the corresponding filling nozzles from the cylinder; and conveying means which are disposed beneath the respective filling nozzles in positions that correspond to the filling nozzles and which hold and rotationally convey containers jars). In this filling apparatus, while the filling rotor rotates once, empty containers are received by the conveying means, the containers are filled with a filling liquid while being rotationally conveyed, and then the filled containers are eventually discharged.

However, the above rotary type continuous filling apparatus has problems. The cylinders of the pump devices are installed in vertical positions. As a result, the space occupied by the cam mechanisms that cause the pistons to move upward and downward beneath each pump device tends to be large. In addition, a downward load is applied to the cam members in the upward movement of the pistons, and an upward load is applied in the downward movement of the pistons. Moreover, a load is applied from all of the pistons. Thus, the overall load is extremely large, the cam members and surrounding structure must be made strong, increasing the size of the cam mechanism and the size of the apparatus itself.

In the above apparatus, furthermore, the cylinders of the pump devices are vertical, and the discharge ports are located at the upper ends of the cylinders. As a result, when the flow passages from the tank to the cylinders and filling nozzles are cleaned, liquid may accumulate inside the upper end portions of the cylinders. Moreover, the flow passages that connect the discharge ports of the cylinders with the filling nozzles are long. And liquid tends to accumulate in these flow passages. Thus, the cleaning characteristics are poor.

SUMMARY OF THE INVENTION

The present invention solves the above problems.

The main object of the present invention is to provide a rotary type continuous filling apparatus which allows the cam mechanisms and the apparatus itself to be made compact, and which is superior in terms of cleaning characteristics.

Other objects of the present invention are, among others, to accomplish the improvement in the filling precision, to prevent accidents that involve knocking of the pistons inside the cylinders, and to prevent the contamination of the bag openings when bags are filled.

The above objects are accomplished by a unique structure for a rotary type continuous filling apparatus that includes:

a tank installed on a continuously rotating filling rotor, a plurality of filling nozzles disposed in vertical positions at equal intervals around the periphery of the filling rotor, pump devices disposed in positions that correspond to the respective filling nozzles, in each of the pump devices a piston making a reciprocating motion upon the rotation of the filling rotor, so that a filling liquid is sucked into a cylinder from the tank and discharged toward the corresponding filling nozzle from the cylinder, and conveying means disposed beneath the respective filling nozzles so as to positionally correspond to the filling nozzles, the conveying means holding and rotationally conveying containers, and in this filling apparatus, while the filling rotor makes one rotation the containers are received by the conveying means, the containers are filled with the filling liquid while being rotationally conveyed, and the containers are then discharged, and the respective cylinders of the pump devices are installed in substantially horizontal positions with their discharge openings facing outward.

In the above structure, besides jars, the above-described containers include bags accommodated in retainers.

The above-described pump devices are equipped with cam mechanisms that reciprocate the pistons. In a desirable configuration of the cam mechanisms, the cam mechanisms have a common piston operating cam and cam rollers. The piston operating cam has an annular cam groove that surrounds the axial center of the filling rotor and is disposed so that it can move to the left and right within a horizontal plane and then appropriately positioned. The cam rollers are connected to the pistons and move along the cam groove. Thus, the pistons make a reciprocating motion as a result of the cam rollers moving along the cam groove as the filling rotor rotates. The cam rollers are connected to the pistons via swing levers which are connected to the rear ends of the pistons so that the levers are horizontally rotatable, vertical supporting shafts which are fastened to the swing levers and attached to the filling rotor so that the shafts are rotatable, and cam levers which are fastened to the supporting shafts.

Furthermore, desirably, each of the filling nozzles comprises a nozzle main body and an up-and-down piston. The nozzle main body has a supply opening, which communicates with the tank in the sidewall of the nozzle main body, a feed-out opening which communicates with the cylinder below the supply opening, and a discharge port at the lower end of the nozzle main body. The up-and-down piston has a flow path switching valve that switches between communication and non-communication of the supply opening and feed-out opening, and a discharge port opening-and-closing valve at the tip end. When the up-and-down piston is raised inside the nozzle main body, the supply opening and feed-out opening are brought in a non-communicating state, and the discharge port is opened. When the up-and-down piston descends inside the nozzle main body, the supply opening and feed-out opening are brought in a communicating state, and the discharge port is closed.

The above filling nozzles are used in a rotary type continuous filling apparatus which has cylinders that are disposed in substantially horizontal positions with the discharge openings that face outward. The above filling nozzles are also used in rotary type continuous filling apparatuses in general which have cylinders disposed in other configurations, e.g., cylinders that are disposed in vertical positions, etc.

In cases where the rotary type continuous filling apparatus fills bags, which are accommodated in retainers, with a filling liquid, it is preferable to design so that the conveying means rotationally convey the bags together with the retainers, a means that raises and lowers the bags together with the retainers while the bags and retainers are being rotationally conveyed is installed, and the opening and closing of the discharge port of each filling nozzle is controlled by an electromagnetic valve. Needless to say, the timing is set so that the raising movement of the retainer with bags therein is performed prior to the discharge of the filling liquid by the filling nozzles and the lowering movement is performed after this discharge. Furthermore, the bags and retainers are raised to a height where the tip ends of the filling nozzles are inserted into the bags.

With the conveying means and filling nozzles having the above configuration, the conveying means and filling nozzles can be used not only in a rotary type continuous filling apparatus which has cylinders that are disposed in substantially horizontal positions with the discharge openings facing outward, but also in rotary type continuous filling apparatuses in general which have cylinders disposed in other configurations, e.g., cylinders that are disposed in vertical positions, etc.

DETAILED DESCRIPTION OF THE INVENTION

The present invention will be described below as being applied to a retainer type filling apparatus with reference to FIGS. 1 through 6.

Figure 1:
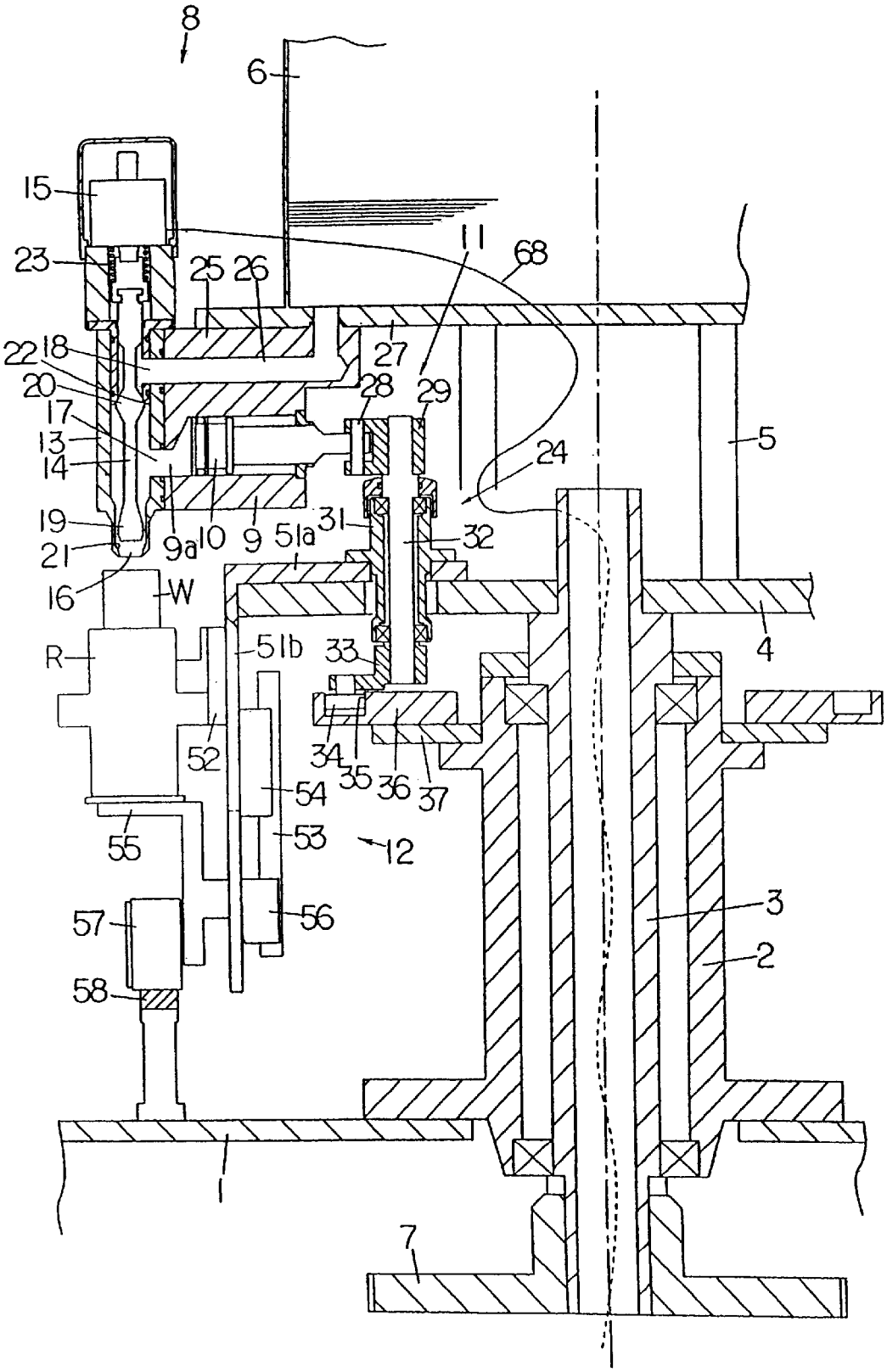
FIG. 1 is a sectional view of a part of the rotary type continuous filling apparatus according to the present invention.
Figure 2:
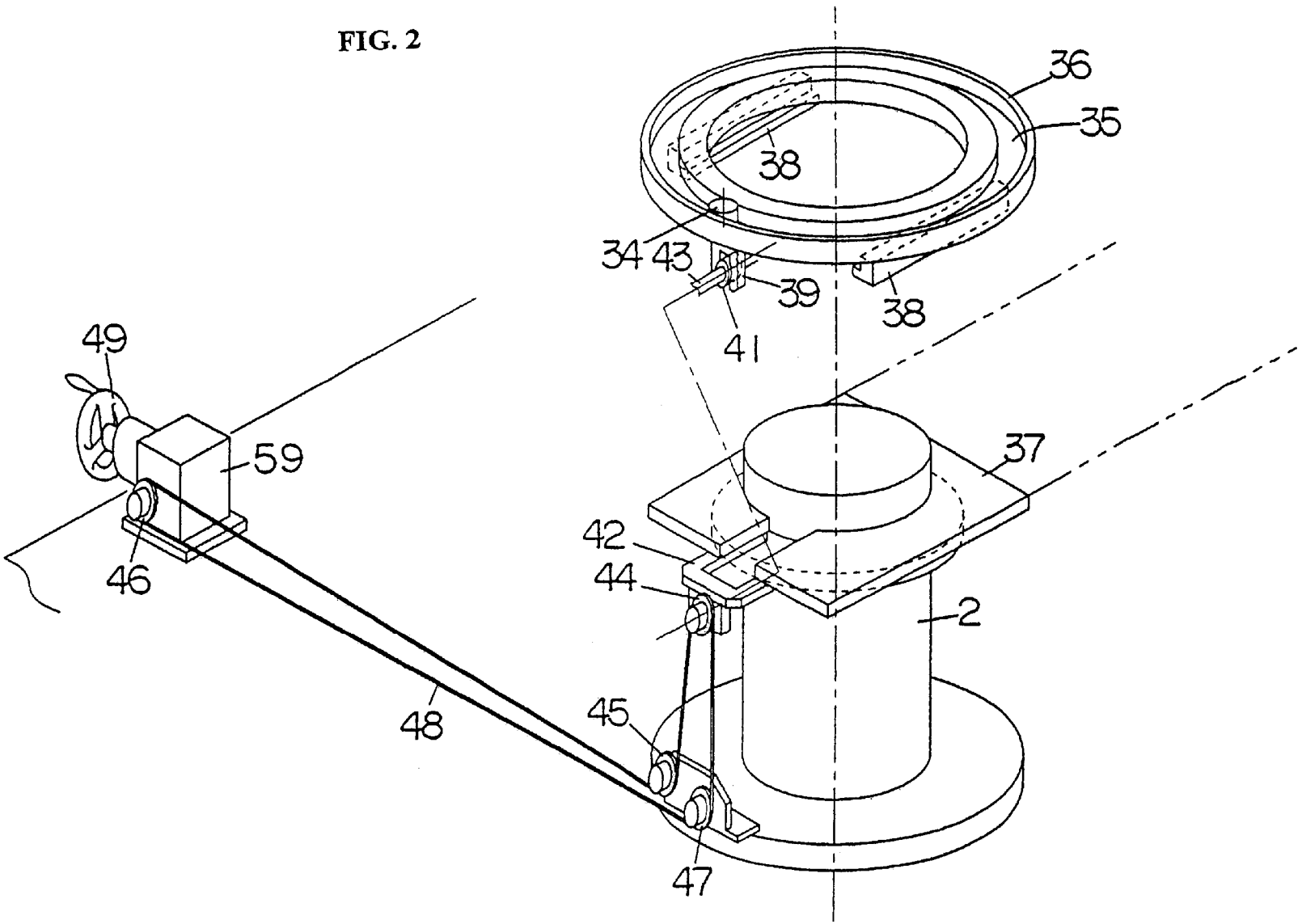
FIG. 2 shows the manner of adjustment of the piston operating cam and the filling amount.

As shown in FIG. 1, a supporting stand 2 is installed in an upright position on a bed 1, and a rotor shaft 3 is rotatably supported in this supporting stand 2. A filling rotor 4 is attached to the upper end of the rotor shaft 3, and a tank 6 is installed on the upper portion of the filling rotor 4 via a plurality of tank attachmnent legs 5. Furthermore, a gear 7 which is connected to a driving means (not shown) is attached to the lower portion of the rotor shaft.

A plurality of filling nozzles 8 are disposed at equal intervals around the circumference of the filling rotor 4. Pump devices 11 each of which comprises a cylinder 9 and piston 10, etc. and a conveying means 12 for a retainer R, etc., are installed facing filling nozzles 8.

Each filling nozzle 8 is constructed from a nozzle main body 13, an up-and-down piston 14 which ascends and descends inside this nozzle main body 13, and an air cylinder 15 which causes the up-and-down piston 14 to ascend and descend. A discharge port 16 is formed in the lower end of the nozzle main body 13. Furthermore, a feed-out opening 17 which communicates with the tip end (discharge opening 9*a*) of the corresponding cylinder 9 is formed at an intermediate position in the side wall of the nozzle main body 13, and a supply opening 18 which communicates with the tank 6 is formed at an upper position in the side wall of the nozzle main body 13. A discharge port opening-and-closing valve 19 is formed at the lower end of the piston 14, and a flow passage opening-and-closing valve 20 is formed at an intermediate position on the piston 14. The discharge port 16 is opened and closed when the discharge port opening-and-closing valve 19 is separated from or contacts a valve seat 21 formed in the lower end of the nozzle main body 13. The supply opening 18 and feed-out opening 17 are switched between a communicating state and a non-communicating state when the flow passage opening-and-closing valve 20 is separated from or contacts a valve seat 22 formed at an intermediate position in the nozzle main body 13. The upper portion of the nozzle main body 13 (i.e., the upper portion of the supply opening 18) is closed off by the up-and-down piston 14.

When the air cylinder 15 is not in operation, the up-and-down piston 14 is caused to descend by a compression spring 23. Accordingly, the discharge port opening-and-closing valve 19 contacts the valve seat 21, and the discharge port 16 is closed. At the same time, the flow passage opening-and-closing valve 20 is separated from the valve seat 22, and the supply opening 18 and feed-out opening 17 communicate with each other. When the air cylinder 15 is actuated, the piston 14 ascends. Accordingly, the discharge port opening-and-closing valve 19 is separated from the valve seat 21, and the discharge port 16 is opened. At the same time, the flow passage opening-and-closing valve 20 contacts the valve seat 22, and the supply opening 18 and feed-out opening 17 are brought in a non-communicating state.

Each of the pump devices 11 is comprised of a cylinder 9, a piston 10 a cam mechanism 24 which operates the piston 10, and other components.

The cylinder 9 and a filling liquid flow passage 26 are formed in a cylinder block 25, and this cylinder block 25 is attached to the bottom plate 27 of the tank 6. The cylinder 9 is disposed in a horizontal position with the discharge opening 9*a* of the cylinder 9 facing outward when seen from the axial center of the filling rotor 4. The discharge opening 9*a* coincides with the feed-out opening 17. Meanwhile, one opening of the flow passage 26 coincides with the supply opening 18, while another opening of the flow passage 26 coincides with an opening formed in the bottom plate 27 of the tank.

The cam mechanism 24 comprises: a swing lever 29 which is connected to the rear end of the piston 10 via a pin 28 so that the swing lever 29 rotates horizontally; a vertical supporting shaft 32 that is, at its upper end, connected to the swing lever 29 and is shaft-supported via a supporting shaft supporting stand 31 so that the supporting shaft 32 rotatable inside the filling rotor 4; a cam lever 33 fastened at its one end to the lower end of the supporting shaft 32; a cam roller 34 which is attached to another end of the cam lever 33 so as to be rotatable in the horizontal direction; and a piston operating cam 36 equipped with an annular groove 35 so that the cam roller 34 rotatably fits in this groove 35. The supporting shaft supporting stand 31 is fastened to the supporting shaft holding portion (horizontal portion) 51*a* of a bracket 51 that is described below.

The piston operating cam 36 is disposed in a horizontal position on a guide plate 37 which is fastened to the supporting stand 2. As seen from FIG. 2, the inward-facing guide surfaces of two guide blocks 38 that are attached to the lower portion of the piston operating cam 36 run along both side edges of the guide plate 37. Accordingly, the piston operating cam 36 is slidable only to the left and right (i.e., in the direction parallel to the guide blocks 38) on the guide plate 37. A nut member 41 is attached to the piston operating cam 36 via a bracket 39. Furthermore, the base portion of a screw 43 is attached to the guide plate 37 via a bracket 42 so that the screw 43 can rotate, and this screw 43 is screw-engaged with the nut member 41. A sprocket 44 is attached to the end portion of the screw 43, and a chain 48 is mounted on this sprocket 44 and on sprockets 45 through 47. When a handle 49 is turned, the chain 48 is rotated via a gear box 59. Accordingly, the screw 43 rotates so that the piston operating cam 36 can be moved to the left or right. Furthermore, by moving the piston operating cam 36 to the left or right, and thus adjusting the amount of eccentricity from the axial center of the filling rotor 4, the stroke of each piston 10, i.e. the amount that is discharged each time from the cylinder 9 (the amount of liquid with which the corresponding bag is filled) can be adjusted. The annular groove 35 may be either substantially circular or elliptical when viewed from above. The shape of the annular groove 35 is selected in accordance with the discharge and suction configurations (e.g., an initially gradual discharge rate that increases at an intermediate point, etc.).

Conveying means 12 for retainers R are installed on the outer circumference of the filling rotor 4 in positions that are beneath the filling nozzles 8 and cylinders 9. Retainer holding members 52, that are known in prior art, are attached to brackets 51 (on the front surface sides of the retainer holding portions (vertical portion) 51*b* of the brackets 51) which are attached to the outer circumference of the filling rotor 4. Slide rails 53 are attached in a vertical attitude to the back surfaces of the retainer holding portions 51*b* via slide rail attachment blocks 54. Furthermore, beneath each retainer holding member 52, a retainer supporting stand 55 is installed so that the retainer supporting stand 55 is freely raised and lowered along the corresponding slide rail 53 via a slide member 56. Moreover, a cam roller 57 is attached to the lower end of the retainer supporting stand 55, and this cam roller 57 contacts an annular raising-and-lowering cam 58 which is disposed on the bed 1.

When the filling rotor 4 rotates, the retainer holding members 52 and retainer supporting stands 55 rotationally convey the retainers R. Furthermore, the cam rollers 57 run over the raising-and-lowering cam 58, so that the retainers R are raised and lowered with an appropriate timing. Of the conveying means 12, the slide rails 53, slide members 56, cam rollers 57 and raising-and-lowering cam 58, etc. constitute the "raising-and-lowering means" in the description.

Figure 3B:
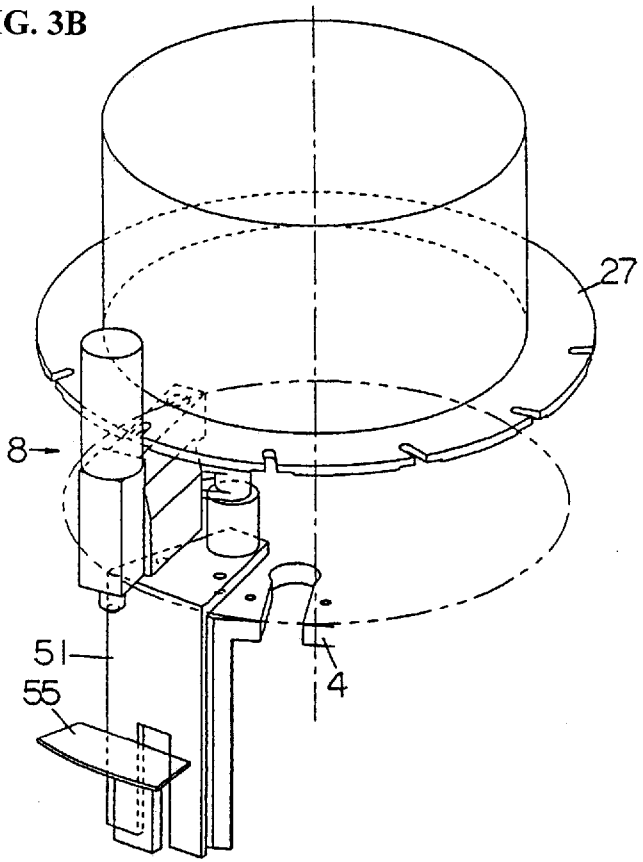
FIGS. 3A and 3B illustrate structures of the components in unit in the filling apparatus.
Figure 3A:
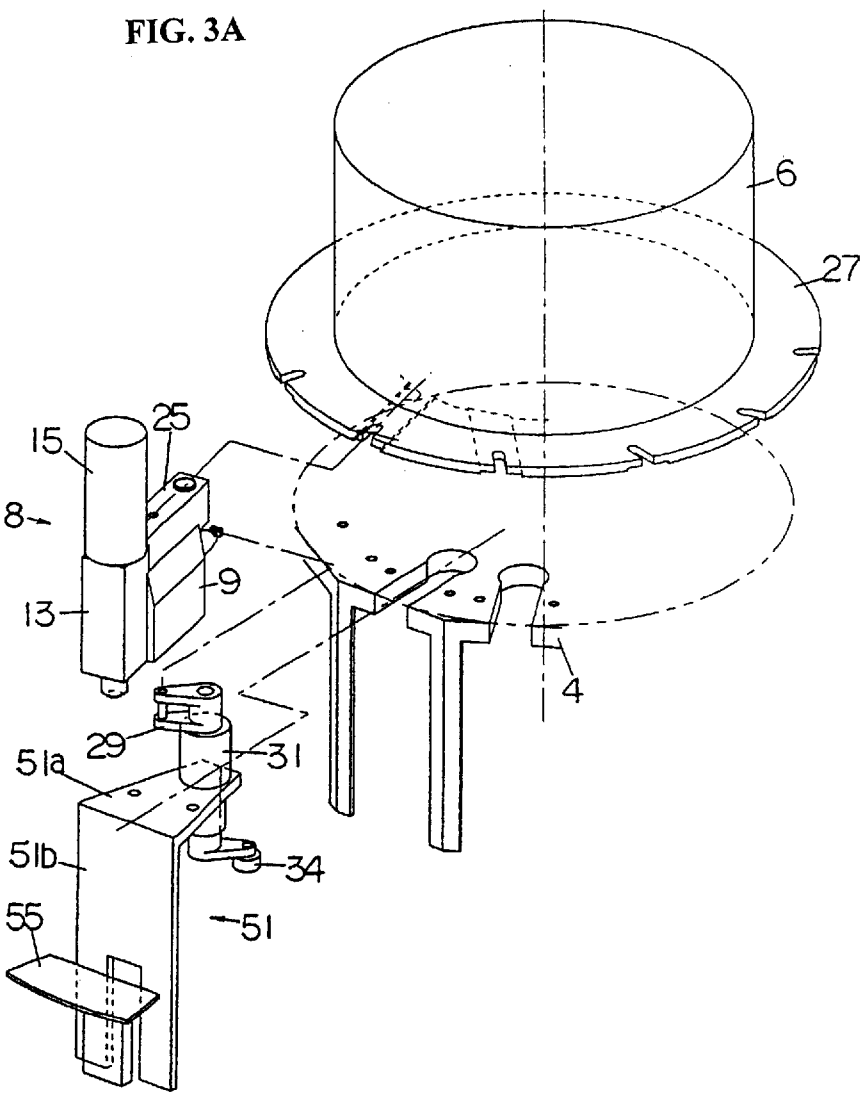

Furthermore, as seen from FIGS. 3A and 3B, the filling nozzles 8, cylinder blocks 25 (cylinders 9 and flow passages 26 communicating with the tank) and pistons 10 are formed into units. Among the components of the cam mechanisms 24 and conveying means 12, those that are directly or indirectly attached to the brackets 51 are also formed into units. In other words, in the apparatus described above, among the filling nozzles 8, pump devices 11 and conveying means 12, the components for the individual filling nozzle 8, except for those that are common to all of the filling nozzles 8 (i.e., the piston operating cam 36, raising-and-lowering cam 58, etc.), are formed into units, so that they are attached and removed on a unit by unit basis.

Figure 4:
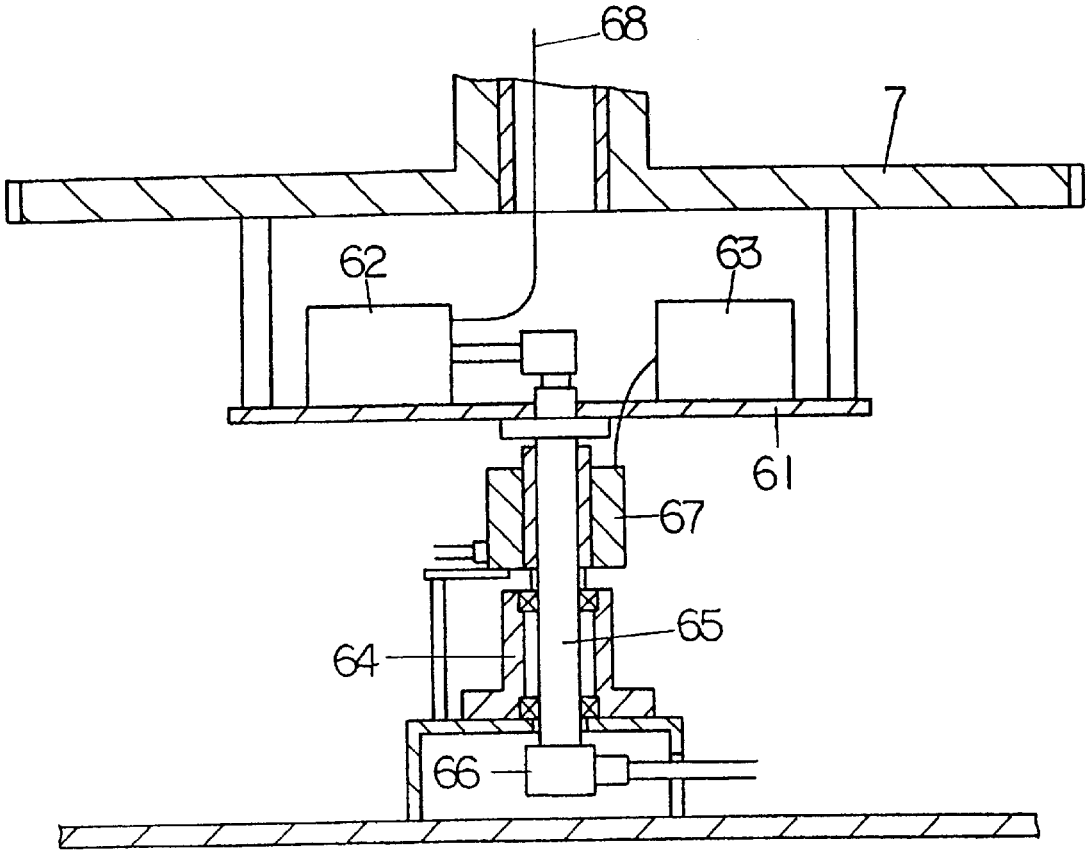
FIG. 4 is a sectional view of the control section of the apparatus.

As shown in FIG. 4, a control section which rotates together with the filling rotor 4 is accommodated in the lower portion of the bed 1. This control section is comprised of: a plurality of electromagnetic valves 62 which are installed in positions that correspond to the respective air cylinders 15 on a turntable 61 which is attached to the gear 7 and rotates together with the gear 7; an AS-i (actuator sensor interface) control device 63 which is a known device and controls the operation of the electromagnetic valves 62; a hollow shaft 65 which is rotatably supported on a bearing 64 and supplies air to the respective electromagnetic valves 62; a rotary air joint 66 which is installed at the lower end of the hollow shaft 65; and a rotary feeder brush 67 which is attached to the outer circumference of the hollow shaft 65. Air piping 68 extends from the respective electromagnetic valves 62 to the corresponding air cylinders 15.

Compressed air is supplied to the respective electromagnetic valves 62 from external piping system via the rotary air joint 66 and hollow shaft 65. Control signals and electric power that operates the respective electromagnetic valves 62 are supplied to the AS-i control device 63 from an external power supply and external control device via the rotary feeder brush 67. The AS-i control device 63 controls the operation of the respective electromagnetic valves 62 (switching between the pressurized side and non-pressurized side). The up and down movement of the up-and-down pistons 14 is thus controlled.

The operation of the above-described rotary type continuous filling apparatus will be described below in the order of the processes involved.

(1) Retainers R that are accommodated with empty bags W by way of existing appropriate devices are introduced into the rotary type continuous filling apparatus from the outside at a specified position. These retainers R are carried on the retainer supporting stands 55 and are held by the retainer holding members 52.

Figure 5:
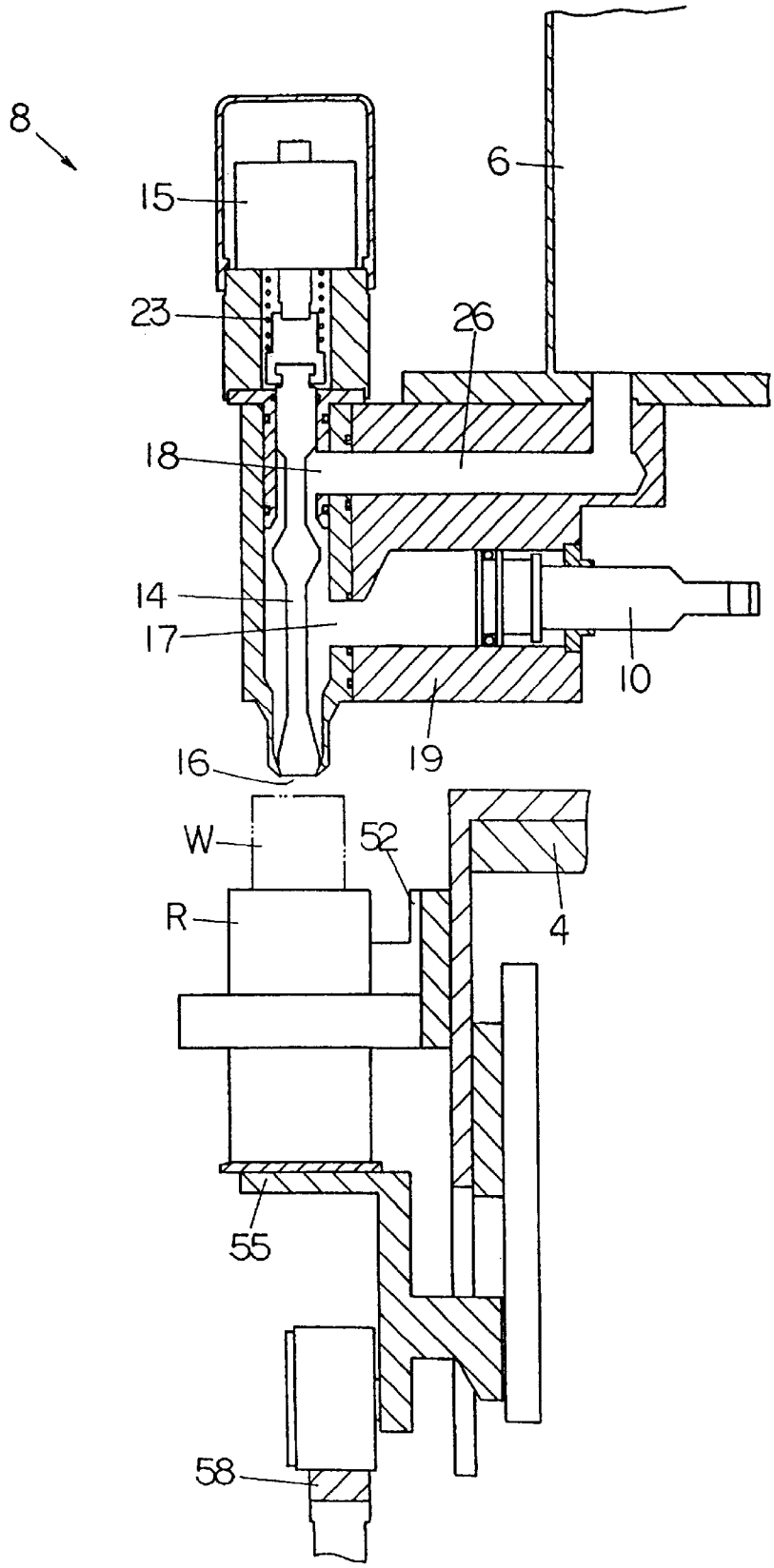
FIG. 5 is a sectional view showing the operation of the apparatus.

In this position, the electromagnetic valves 62 are on the non-pressurized side, so that the air cylinders 15 are in a non-operating state as shown in FIG. 5. Accordingly, the pistons 14 are lowered by the compression springs 23 so that the discharge ports 16 are closed, and the supply openings 18 and feed-out openings 17 communicate with each other. Furthermore, the pistons 10 are retracted by the cam mechanisms 24, and a specified amount of filling liquid is introduced from the tank 6 into the cylinders 9 and metered via the flow passages 26, supply openings 18, interiors of the nozzle main bodies 13 and feed-out openings 17.

(2) When the filling nozzles 8 and pump devices 11 rotate by the rotation of the filling rotor 4, and the retainers R are rotationally conveyed at the same time, the retainer supporting stands 55 are raised by the action of the cam 58, so that the discharge ports 16 of the filling nozzles 8 enter into the bag W. Then, the electromagnetic valves 62 are switched to the pressurized side, and the air cylinders 15 are actuated. As a result, the pistons 14 are raised overcoming the force of the compression spring 23, thus causing the discharge ports 16 to open, and placing the supply openings 18 and feed-out openings 17 in a non-communicating state.

Figure 6:
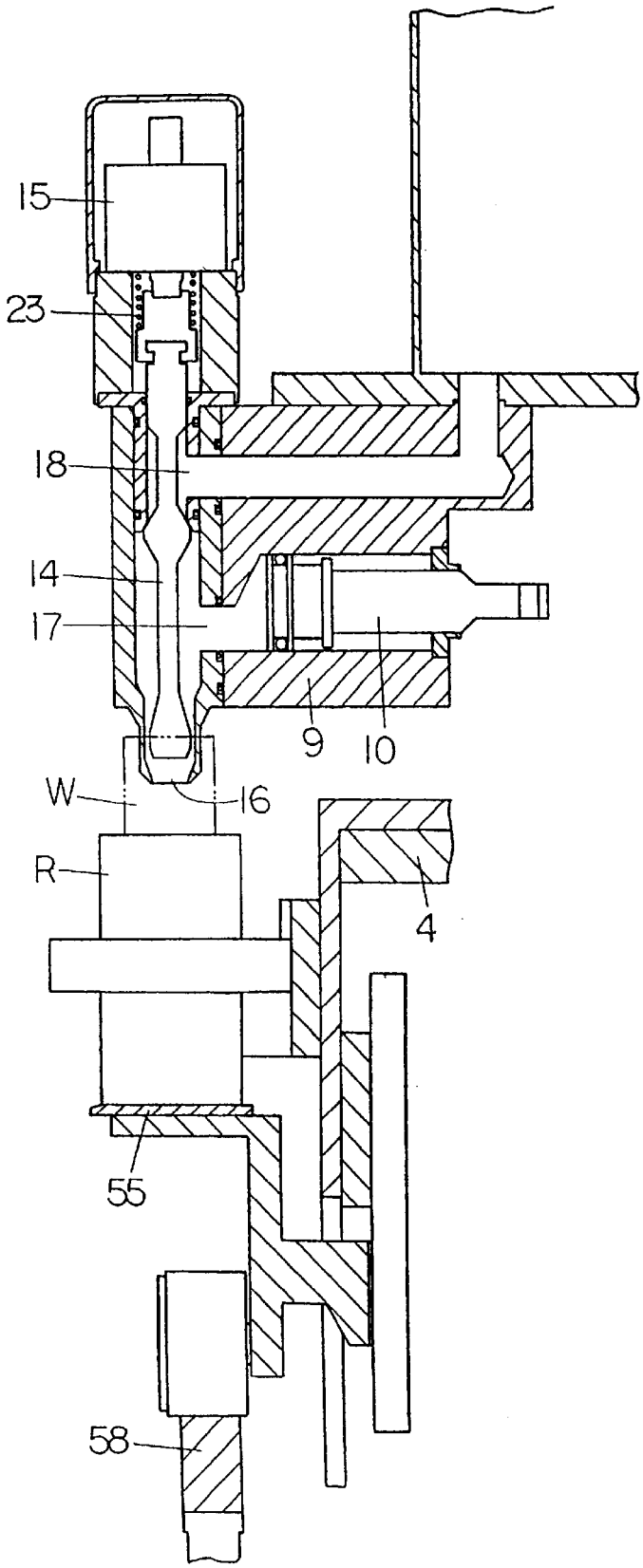
FIG. 6 is a sectional view showing the operation of the apparatus.

(3) As the filling rotor 4 rotates further, the pistons 10 are caused to advance by the cam mechanisms 24 as shown in FIG. 6, and the measured amount of filling liquid inside the cylinders 9 is discharged into the bags W.

(4) The filling rotor 4 rotates further, and the electromagnetic valves 62 are switched to the non-pressurized side, so that the air cylinders 15 become inoperative. As a result, the pistons 14 are caused to drop by the compression springs 23, so that the discharge ports 16 are closed, and the supply openings 18 and feed-out openings 17 are brought in a communicating state. At the same time, the pistons 10 begin to be retracted by the cam mechanisms 24, and a specified amount of the filling liquid is metered while being introduced into the cylinders 9 from the tank 6 via the flow passages 26, supply openings 18, and the interiors of the nozzle main bodies 13 and feed-out openings 17. During this operation, the retainer holding stands 55 are lowered by the action of the cam 58, and the retainers R having therein the filled bags are discharged to the outside of the apparatus in a manner known by prior art.

The characterizing structures of the above-described rotary type continuous filling apparatus of the present invention and the advantages arising from such structures are summarized as follows:

(1) The cylinders 9 of the pump devices are installed in a horizontal attitude so that the discharge openings 9*a* of the cylinders 9 face outward. Accordingly, the length of the flow passages between the cylinders 9 and the filling nozzles 8 becomes minimal, and the rear ends of all of the pistons 10 gather near the center of the filling rotor 4. Accordingly, the cam mechanisms 24 that drive the pistons 10 are gathered in the vicinity of this center, and the overall disposition is compact. For instance, the diameter of the piston operating cam 36 can be made smaller than in the conventional apparatus.

Furthermore, since the cylinders 9 are installed horizontally, contaminated water tends not to accumulate inside the cylinders 9 during, for instance, cleaning. Especially, when the inside walls and discharge openings 9*a* of the cylinders 9 and the height of the bottom surfaces of the feed-out openings 17 of the filling nozzles 8 are aligned, contaminated water easily flows out via the filling nozzles 8. The above structure to connect the discharge openings 9*a* and feed-out openings 17 by a minimal distance also helps improvement in the cleaning characteristics. Moreover, when the cylinders 9 are inclined so that the discharge openings face downward, then the outflow of the contaminated water is facilitated even further.

(2) The piston operating cam 36 of the cam mechanisms 24 has an annular cam groove 35 that surrounds the axial center of the filling rotor 4. The cam followers (cam rollers 34) move along this cam groove 35, and the piston operating cam 36 moves to the left and right within the horizontal plane and can be appropriately positioned. Accordingly, the stroke of the pistons 10 (the amount of filling that is performed in a single filling operation) can be adjusted by way moving the piston operating cam 36 to the left and right and adjusting the amount of eccentricity of the filling rotor 4 from its axis line. Since the amount of movement in this case has a doubled effect on the stroke of the pistons, the amount of adjustment by means of the liquid amount adjustment handle 49 that is required becomes relatively small.

Furthermore, the load applied to the piston operating cam 36 from the respective cam rollers 34 due to the advance or retraction of the pistons 10 during the rotational operation of the filling rotor 4 is more or less canceled in the direction of movement of the piston operating cam 36. Accordingly, no great load is applied to the movement means (that are the screw 43 and nut 41 in the shown embodiment), and there is little trouble with the movement means. Furthermore, a large load is applied in one direction perpendicular to the above-described direction of movement. In this case, however, the load is received by the guide blocks 38 and guide plate 37, and the piston operating cam 36 slides on the horizontal plane. Accordingly, firm holding is accomplished by a simple structure compared to the case of the inclined holding employed in conventional systems. Thus, the positioning precision (filling precision) also increases.

(3) When the cam rollers 34 are connected to the pistons 10 via the swing levers 29, supporting shafts 32 and cam levers 33, then the stroke of the pistons 10 changes according to the lever ratio even if the movement of the cam roller 34 is the same. Accordingly, a large stroke can be obtained even with a small-diameter piston operating cam 36.

(4) The filling nozzles 8 are designed so that either the supply opening 18 or the discharge port 16 is always open. Accordingly, accidents that involve knocking of the pistons 10 inside the cylinders 9 can be avoided regardless of the conditions of operation of the pistons 10. Furthermore, by way of keeping the discharge port opening-and-closing valve 19 and flow passage opening-and-closing valve 20 of each filling nozzle 8 in a neutral position, a cleaning liquid can flow through the interiors of the filling nozzle main bodies 13. Thus, the apparatus has improved cleaning characteristics. On the other hand, in the conventional system in which an opening-and-closing valve is installed at the tip end of each filling nozzle, and switching between the cylinder and the filling nozzle or tank is accomplished by a separate three-way valve, knocking occurs when there is a deviation in the timing of the opening and closing of the opening-and-closing valve or the switching of the three-way valve, resulting in damages in the apparatus by excessive loads. Furthermore, the cleaning characteristics are also poor in such a conventional system.

(5) The conveying and raising-and-lowering means 12 are provided for the retainers R. Thus, the tip ends of the filling nozzles 8 are brought into the interiors of the bags through the bag openings at the time of filling, and no contamination of the bag openings or surrounding apparatus occurs as a result of splashing of the filling liquid, etc. This filling nozzles 8 are inserted into the bag openings, and the opening and closing of the discharge ports is controlled by electromagnetic valves; and the filling nozzles seen in convention jar filling apparatuses (i.e., filling nozzles of the type in which the openings of the jars contact the discharge ports of the filling nozzles, and open the valves by pressing against the discharge ports) are not employed.

(6) The respective electromagnetic valves 62 that rotate together with the filling rotor 4 supply the compressed air to the respective air cylinders 15, and the compressed air is supplied to these electromagnetic valves 62 from the common rotary air joint 66. Thus, the structure of the rotary air joint is simple.

(7) The up-and-down pistons 14 that control the opening-and-closing valves of the respective filling nozzles 8 are operated by the air cylinders 15, and the supply of the compressed air to the respective air cylinders 15 is controlled by the electromagnetic valves 62 that rotate together with the filling rotor 4. In addition, the respective electromagnetic valves 62 are controlled by the AS-i control device 63, which likewise rotates together with the filling rotor 4. Accordingly, in cases where, for instance, a bag whose opening is not opened is in one of the retainers, a detection signal that detects the non-open bag is transmitted to the AS-i control device 63, and the filling only for this closed bag is executed. Conventionally, when there is a closed bag, it has been necessary to remove the closed bag from the filling line along with the corresponding retainer and supply a retainer that accommodates an opened bag to the filling apparatus.

When the AS-i control device 63 is used, electrical control signals from the outside are received via the rotary feeder brush 67. However, it is also possible to use optical signals as control signals (in a non-contact control operation in this case) as disclosed in, for instance, Japanese Patent Application Laid-Open (Kokai) No. H8-295397.

The above-described control system is applied not only to the rotary type continuous filling apparatus concretely described above but also to rotary type continuous filling apparatuses in general. In other words, the present invention is for a rotary type continuous filling apparatus that comprises: a tank installed on a continuously rotating filling rotor, a plurality of filling nozzles vertically disposed at equal intervals around the periphery of the filling rotor, pump devices which are disposed so as to correspond to the respective filling nozzles and in each of the pump devices a piston makes a reciprocating motion upon the rotation of the filling rotor so that a filling liquid is sucked into a cylinder from the tank and discharged toward the corresponding filling nozzle from the cylinder, and conveying means disposed beneath the respective filling nozzles in positions that correspond the filling nozzles and hold and rotationally convey containers, so that in this filling apparatus the containers are received by the conveying means, these containers are filled with the filling liquid while being rotationally conveyed, and the containers are then discharged while the filling rotor rotates once; and further, air cylinders which control the operation of the discharge port opening-and-closing valve and switching between suction intake and discharge of pump device are installed for the filling nozzles, electromagnetic valves which rotate together with the filling rotor and control the supply of compressed air supplied from the outside to the respective air cylinders are installed so as to correspond to the respective air cylinders, and a control device that rotates together with the filling rotor and controls the operation of the respective electromagnetic valves is further provided.

As seen from the above, according to the rotary type continuous filling apparatus of the present invention, the cam mechanisms and the apparatus itself can be compact. The apparatus is superior in terms of the cleaning characteristics of its flow passages. Moreover, it provides an improved filling precision, the occurrence of accidents that involve knocking of the pistons inside the cylinders is prevented, and contamination of the openings of the bags upon filling is prevented.

What is claimed is:

1. A rotary type continuous filling apparatus comprising:

a tank installed on a continuously rotating filling rotor;

a plurality of filling nozzles disposed vertically at equal intervals around a periphery of said filling rotor;

pump devices provided so as to correspond to said filling nozzles, a piston of each of said pump devices making a reciprocating motion upon a rotation of said filling rotor, thus introducing a filling liquid into a cylinder of each of said pump devices from said tank and discharging said filling liquid toward said filling nozzle from said cylinder; and conveying means provided beneath said respective filling nozzles in positions that correspond to said filling nozzles, said conveying means holding and rotationally conveying containers, wherein while said filling rotor makes one rotation, said containers are received by said conveying means, filled with said filling liquid while being rotationally conveyed, and then discharged from said filling apparatus, and wherein said cylinder and piston are installed in substantially a horizontal direction with a discharge opening thereof facing outward.

2. The rotary type continuous filling apparatus according to claim 1, wherein said pump devices are equipped with cam mechanisms which drive said pistons in a reciprocating motion upon said rotation of said filling rotor, said cam mechanisms comprises:

a common piston operating cam which is disposed so as to be moved on a horizontal plane and positioned at an appropriate position, said cam having an annular cam groove that surrounds an axial center of said filling rotor; and cam rollers connected to said pistons and move along said cam groove, wherein said pistons reciprocate as a result of said cam rollers moving along said cam groove upon said rotation of said filling rotor.

3. The rotary type continuous filling apparatus according to claim 2, wherein said cam mechanisms further comprises:

swing levers connected to one ends of said pistons so that said levers are horizontally rotatable;

vertical supporting shafts fastened to said swing levers and attached to said filling rotor so that said shafts are rotatable; and cam levers fastened to said supporting shafts, said cam rollers being attached to said cam levers so that said cam rollers are rotatable in a horizontal direction.

4. The rotary type continuous filling apparatus according to any one of claims 1 through 3, wherein each of said filling nozzles comprises:

a nozzle main body provided with a supply opening which communicates with said tank, a feed-out opening which is formed below said supply opening and communicates with said cylinder, and a discharge port which is formed at a lower end of said nozzle main body; and an up-and-down piston that has a flow path switching valve and a discharge port opening-and-closing valve, said flow path switching valve for switching between communication and non-communication of said supply opening and feed-out opening, and said discharge port opening-and-closing valve being formed at a lower end of said up-and-down piston, wherein when said up-and-down piston is raised inside said nozzle main body, said supply opening and said feed-out opening are brought in a non-communicating state, and said discharge port is opened; and when said up-and-down piston is lowered inside said nozzle main body, said supply opening and said feed-out opening are brought in a communicating state, and said discharge port is closed.

5. The rotary type continuous filling apparatus according to any one of claims 1 through 3, wherein said rotary type continuous filling apparatus fills said filling liquid into bags that are accommodated in retainers;

said conveying means rotationally convey said bags together with said retainers and are equipped with a raising-and-lowering means that raises and lowers said bags together with said retainers while said bags and retainers are being rotationally conveyed; and an electromagnetic valve is further provided that controls opening and closing of said discharge port of each of said filling nozzles.

6. The rotary type continuous filling apparatus according to claim 4, wherein said rotary type continuous filling apparatus fills said filling liquid into bags that are accommodated in retainers;

said conveying means rotationally convey said bags together with said retainers and are equipped with a raising-and-lowering means that raises and lowers said bags together with said retainers while said bags and retainers are being rotationally conveyed; and an electromagnetic valve is further provided that controls opening and closing of said discharge port of each of said filling nozzles.

* * * * *

UNITED STATES PATENT AND TRADEMARK OFFICE

CERTIFICATE OF CORRECTION

PATENT NO. : 6,378,574 B2
DATED : April 30, 2002
INVENTOR(S) : Shoji Tsutsui

It is certified that error appears in the above-identified patent and that said Letters Patent is hereby corrected as shown below:

Column 12,
After line 3, add Claims 7 and 8 as follows:

Claim 7,
7. A rotary type continuous filling apparatus comprising:

a tank installed on a continuously rotating filling rotor;

a plurality of filling nozzles disposed vertically at equal intervals around a periphery of said filling rotor;

pump devices provided so as to correspond to said filling nozzles, a piston of each of said pump devices making a reciprocating motion upon a rotation of said filling rotor, thus introducing a filling liquid into a cylinder of each of said pump devices from said tank and discharging said filling liquid toward said filling nozzle from said cylinder; and conveying means provided beneath said respective filling nozzles in positions that correspond to said filling nozzles, said conveying means holding and rotationally conveying containers, wherein while said filling rotor makes one rotation, said containers are received by said conveying means, filled with said filling liquid while being rotationally conveyed, and then discharged from said filling apparatus, and wherein each of said filling nozzles comprises:

a nozzle main body provided with a supply opening which communicates with said tank, a feed-out opening which is formed below said supply opening and communicates with said cylinder, and a discharge port which is formed at a lower end of said nozzle main body; and an up-and-down piston that has a flow path switching valve and a discharge port opening-and-closing valve, said flow path switching valve for switching between communication and non-communication of said supply opening and feed-out opening, and said discharge port opening-and-closing valve being formed at a lower end of said up-and-down piston, so that when said up-and-down piston is raised inside said nozzle main body, said supply opening and said feed-out opening are brought in a non-communicating state, and said discharge port is opened; and when said up-and-down piston is lowered inside said nozzle main body, said supply opening and said feed-out opening are brought in a communicating state, and said discharge port is closed.

Claim 8,
8. A rotary type continuous filling apparatus comprising:

a tank installed on a continuously rotating filling rotor;

a plurality of filling nozzles disposed vertically at equal intervals around a periphery of said filling rotor;

pump devices provided so as to correspond to said filling nozzles, a piston of each of said pump devices making a reciprocating motion upon a rotation of said filling rotor, thus introducing a filling liquid into a cylinder of each of said pump devices from said tank and discharging said filling liquid toward said filling nozzle from said cylinder; and

UNITED STATES PATENT AND TRADEMARK OFFICE

CERTIFICATE OF CORRECTION

PATENT NO. : 6,378,574 B2
DATED : April 30, 2002
INVENTOR(S) : Shoji Tsutsui

It is certified that error appears in the above-identified patent and that said Letters Patent is hereby corrected as shown below:

conveying means provided beneath said respective filling nozzles in positions that correspond to said filling nozzles, said conveying means holding and rotationally conveying retainers that accommodate therein bags, wherein while said filling rotor makes one rotation, said retainers are received by said conveying means, said bags are filled with said filling liquid while being rotationally conveyed, and then said retainers are discharged from said filling apparatus, and wherein said filling apparatus is further comprised of:

a raising-and-lowering means that is provided in said conveying means and raises and lowers said bags together with retainers while said bags and retainers are being rotationally conveyed; and an electromagnetic valve that controls opening and closing of said discharge port of each of said filling nozzle.

Signed and Sealed this

Fifteenth Day of July, 2003

JAMES E. ROGAN
*Director of the United States Patent and Trademark Office*